US011571060B2

(12) United States Patent
Jungnickel

(10) Patent No.: US 11,571,060 B2
(45) **Date of Patent: *Feb. 7, 2023**

(54) HEAD FOR AN ORAL-CARE IMPLEMENT AND A KIT COMPRISING SUCH HEAD

(71) Applicant: The Gillette Company LLC, Boston, MA (US)

(72) Inventor: Uwe Jungnickel, Königstein (DE)

(73) Assignee: The Gillette Company LLC, Boston, MA (US)

( * ) Notice: Subject to any disclaimer, the term of this patent is extended or adjusted under 35 U.S.C. 154(b) by 104 days.

This patent is subject to a terminal disclaimer.

(21) Appl. No.: 16/551,307

(22) Filed: Aug. 26, 2019

(65) Prior Publication Data

US 2020/0121069 A1 Apr. 23, 2020

Related U.S. Application Data

(63) Continuation of application No. PCT/US2019/047617, filed on Aug. 22, 2019.

(30) Foreign Application Priority Data

Sep. 3, 2018 (EP) ..... 18192263

(51) Int. Cl.
*A46B 9/04* (2006.01)
*A46B 9/02* (2006.01)

(52) U.S. Cl.
CPC ..... *A46B 9/04* (2013.01); *A46B 9/025* (2013.01); *A46B 9/028* (2013.01); *A46B 2200/1066* (2013.01)

(58) Field of Classification Search
CPC ..... A46B 9/025; A46B 9/028
(Continued)

(56) References Cited

U.S. PATENT DOCUMENTS 3,927,435 A 12/1975 Moret
4,384,645 A 5/1983 Manfredi
(Continued)

FOREIGN PATENT DOCUMENTS

CN 2320102 5/1999
CN 1223834 7/1999
(Continued)

OTHER PUBLICATIONS

European Search Report dated Feb. 7, 2019, 5 pages.
(Continued)

*Primary Examiner* — Don M Anderson
*Assistant Examiner* — Jonathan G Santiago Martinez
(74) *Attorney, Agent, or Firm* — Vladimir Vitenberg; Gregory S. Darley-Emerson

(57) ABSTRACT

A head for an oral-care implement, having an elongated mounting surface with an outer circumference, includes two outer rows of tufts extending from the mounting surface along a longitudinal axis and in proximity to the outer circumference and an arc-shaped toe arranged at a distal end and composed of filaments or a plurality of tufts of filaments. The tufts of the outer rows have a longitudinal extension and an elongated cross-sectional area extending substantially perpendicular to the longitudinal extension, the elongated cross-sectional area having a longer axis and a shorter axis, wherein the longer axis defines an angle α of from about 20° to about 65° with respect to the longitudinal axis, so that the tufts of the outer rows and the arc-shaped toe define an outer arc-shaped envelope.

21 Claims, 8 Drawing Sheets

(58) Field of Classification Search
USPC ..... 15/167.1
See application file for complete search history.

(56) References Cited

U.S. PATENT DOCUMENTS

| | | | | |
|---|---|---|---|---|
| 4,811,445 | A | 3/1989 | Lagieski | |
| 5,109,563 | A | 5/1992 | Lemon et al. | |
| 5,335,389 | A | 8/1994 | Curtis et al. | |
| 5,361,446 | A | 11/1994 | Rufo | |
| 5,369,835 | A | 12/1994 | Clarke | |
| 5,875,510 | A | 3/1999 | Lamond et al. | |
| 5,956,796 | A | 9/1999 | Lodato | |
| 5,992,423 | A | 11/1999 | Tevolini | |
| 6,015,328 | A | 1/2000 | Glaser | |
| 6,086,373 | A | 7/2000 | Schiff | |
| 6,230,716 | B1 | 5/2001 | Minoletti | |
| 6,308,367 | B1 | 10/2001 | Beals et al. | |
| 6,643,886 | B2 | 11/2003 | Moskovich | |
| 6,671,919 | B2 | 1/2004 | Davis | |
| 6,871,373 | B2 | 3/2005 | Driesen | |
| 7,137,166 | B1 | 11/2006 | Kraemer | |
| 8,387,197 | B2 | 3/2013 | Moskovich | |
| 8,563,020 | B2 | 10/2013 | Uhlmann | |
| 8,727,141 | B2 | 5/2014 | Akalin | |
| 8,931,855 | B1 | 1/2015 | Foley et al. | |
| 8,966,697 | B2 | 3/2015 | Kim et al. | |
| 9,049,921 | B1 | 6/2015 | Rackston | |
| 9,066,579 | B2 | 6/2015 | Hess | |
| 9,161,544 | B2 | 10/2015 | Agrawal et al. | |
| 9,168,117 | B2 | 10/2015 | Yoshida et al. | |
| 9,226,508 | B2 | 1/2016 | Uhlmann et al. | |
| 9,265,335 | B2 | 2/2016 | Foley et al. | |
| 9,402,461 | B2 * | 8/2016 | Brik | A46B 9/025 |
| 9,427,077 | B1 | 8/2016 | Zhang | |
| D775,469 | S | 1/2017 | Sikora et al. | |
| 9,539,750 | B2 | 1/2017 | Gross et al. | |
| 9,609,940 | B2 | 4/2017 | Corbett | |
| 9,642,682 | B2 | 5/2017 | Kato | |
| D814,195 | S | 4/2018 | Sikora et al. | |
| 10,195,005 | B2 | 2/2019 | Wallström et al. | |
| 10,667,892 | B2 | 6/2020 | Bärtschi et al. | |
| 10,792,136 | B2 | 10/2020 | May et al. | |
| D901,183 | S | 11/2020 | Jungnickel et al. | |
| D912,988 | S | 3/2021 | Langhammer | |
| D917,298 | S | 4/2021 | Hallein et al. | |
| D926,048 | S | 7/2021 | Hallein et al. | |
| D926,049 | S | 7/2021 | Hallein et al. | |
| D927,972 | S | 8/2021 | Hallein et al. | |
| D930,990 | S | 9/2021 | Hallein et al. | |
| D931,617 | S | 9/2021 | Hallein et al. | |
| D931,619 | S | 9/2021 | Hallein et al. | |
| D933,368 | S | 10/2021 | Albay et al. | |
| D936,484 | S | 11/2021 | Hallein et al. | |
| 2003/0115706 | A1 | 6/2003 | Ponzini | |
| 2004/0016073 | A1 | 1/2004 | Knutson | |
| 2004/0060138 | A1 | 4/2004 | Pfenniger et al. | |
| 2005/0022322 | A1 | 2/2005 | Jimenez et al. | |
| 2005/0268414 | A1 | 12/2005 | Kim | |
| 2005/0286967 | A1 | 12/2005 | Blauzdys | |
| 2006/0086370 | A1 | 4/2006 | Omeara | |
| 2008/0120795 | A1 | 5/2008 | Reinbold | |
| 2008/0220235 | A1 | 9/2008 | Izumi | |
| 2009/0089950 | A1 | 4/2009 | Moskovich et al. | |
| 2010/0115724 | A1 | 5/2010 | Huang | |
| 2010/0282274 | A1 | 11/2010 | Huy | |
| 2011/0016651 | A1 | 1/2011 | Piserchio | |
| 2011/0146015 | A1 | 6/2011 | Moskovich | |
| 2012/0036663 | A1 | 2/2012 | Chen | |
| 2012/0073072 | A1 | 3/2012 | Moskovich et al. | |
| 2012/0090117 | A1 | 4/2012 | Akalin | |
| 2012/0198640 | A1 | 8/2012 | Jungnickel et al. | |
| 2012/0227200 | A1 | 9/2012 | Kraemer | |
| 2012/0301528 | A1 | 11/2012 | Uhlmann | |
| 2012/0301530 | A1 | 11/2012 | Uhlmann | |
| 2012/0301531 | A1 | 11/2012 | Uhlmann | |
| 2012/0301533 | A1 | 11/2012 | Uhlmann | |
| 2013/0000059 | A1 | 1/2013 | Jungnickel et al. | |
| 2013/0171225 | A1 | 7/2013 | Uhlmann | |
| 2013/0291326 | A1 | 11/2013 | Mintel | |
| 2013/0315972 | A1 | 11/2013 | Krasnow et al. | |
| 2014/0137349 | A1 | 5/2014 | Newman | |
| 2014/0259474 | A1 | 9/2014 | Sokol et al. | |
| 2014/0359957 | A1 * | 12/2014 | Jungnickel | A46B 9/025 15/167.1 |
| 2014/0359958 | A1 | 12/2014 | Jungnickel | |
| 2015/0034858 | A1 | 2/2015 | Raman | |
| 2015/0143651 | A1 | 5/2015 | Foley et al. | |
| 2015/0147372 | A1 | 5/2015 | Agrawal et al. | |
| 2015/0245618 | A9 | 9/2015 | Agrawal et al. | |
| 2015/0289635 | A1 | 10/2015 | Erskine-Smith | |
| 2015/0305487 | A1 | 10/2015 | Pardo et al. | |
| 2015/0351406 | A1 | 12/2015 | Wingfield | |
| 2016/0135579 | A1 | 5/2016 | Tschol et al. | |
| 2016/0135580 | A1 | 5/2016 | Tschol et al. | |
| 2016/0220014 | A1 | 8/2016 | Sprosta | |
| 2017/0079418 | A1 | 3/2017 | Mintel | |
| 2017/0347782 | A1 | 12/2017 | Jimenez et al. | |
| 2017/0347786 | A1 | 12/2017 | Jimenez et al. | |
| 2017/0367469 | A1 | 12/2017 | Jimenez et al. | |
| 2018/0016408 | A1 | 1/2018 | Stibor | |
| 2018/0055206 | A1 | 3/2018 | Nelson et al. | |
| 2018/0311023 | A1 | 11/2018 | Yao | |
| 2019/0000223 | A1 | 1/2019 | Alinski | |
| 2019/0069978 | A1 | 3/2019 | Katano et al. | |
| 2019/0104835 | A1 | 4/2019 | Alinski | |
| 2019/0117356 | A1 | 4/2019 | Bärtschi et al. | |
| 2019/0200740 | A1 | 7/2019 | Jungnickel | |
| 2019/0200742 | A1 | 7/2019 | Jungnickel | |
| 2019/0200743 | A1 | 7/2019 | Jungnickel | |
| 2019/0200748 | A1 | 7/2019 | Görich | |
| 2019/0246779 | A1 | 8/2019 | Jungnickel et al. | |
| 2019/0246780 | A1 | 8/2019 | Jungnickel et al. | |
| 2019/0246781 | A1 | 8/2019 | Jungnickel et al. | |
| 2019/0248049 | A1 | 8/2019 | Jungnickel et al. | |
| 2020/0022793 | A1 | 1/2020 | Scherrer et al. | |
| 2020/0077778 | A1 | 3/2020 | Jungnickel | |
| 2020/0305588 | A1 | 10/2020 | Jungnickel | |
| 2021/0120948 | A1 | 4/2021 | Görich et al. | |
| 2021/0128286 | A1 | 5/2021 | Jungnickel et al. | |
| 2021/0212446 | A1 | 7/2021 | Jungnickel | |
| 2021/0212447 | A1 | 7/2021 | Jungnickel et al. | |
| 2021/0212448 | A1 | 7/2021 | Jungnickel | |
| 2021/0220101 | A1 | 7/2021 | Jungnickel et al. | |
| 2021/0259818 | A1 | 8/2021 | Jungnickel et al. | |
| 2021/0307496 | A1 | 10/2021 | Jungnickel et al. | |
| 2021/0315368 | A1 | 10/2021 | Jungnickel | |
| 2021/0315369 | A1 | 10/2021 | Jungnickel | |
| 2021/0315370 | A1 | 10/2021 | Jungnickel | |
| 2021/0315675 | A1 | 10/2021 | Jungnickel | |

FOREIGN PATENT DOCUMENTS

| | | | |
|---|---|---|---|
| CN | 1229341 | A | 9/1999 |
| CN | 1229622 | | 9/1999 |
| CN | 2346277 | | 11/1999 |
| CN | 1241123 | A | 1/2000 |
| CN | 201036392 | | 3/2008 |
| CN | 201185740 | | 1/2009 |
| CN | 201563874 | U | 9/2010 |
| CN | 201630520 | | 11/2010 |
| CN | 201675294 | | 12/2010 |
| CN | 201861064 | | 6/2011 |
| CN | 201861068 | | 6/2011 |
| CN | 202035662 | | 11/2011 |
| CN | 202269590 | U | 6/2012 |
| CN | 202286879 | | 7/2012 |
| CN | 202476817 | | 10/2012 |
| CN | 102907880 | | 2/2013 |
| CN | 102948997 | | 3/2013 |
| CN | 202820100 | | 3/2013 |
| CN | 202941615 | | 5/2013 |
| CN | 202980745 | | 6/2013 |
| CN | 103829559 | | 6/2014 |
| CN | 103844575 | | 6/2014 |

(56) References Cited

FOREIGN PATENT DOCUMENTS

| | | | |
|---|---|---|---|
| CN | 104768420 | A | 7/2015 |
| CN | 105054571 | | 11/2015 |
| CN | 205082879 | | 3/2016 |
| CN | 105534002 | | 5/2016 |
| CN | 105750734 | | 7/2016 |
| CN | 105818322 | | 8/2016 |
| CN | 205568222 | | 9/2016 |
| CN | 106312244 | A | 11/2016 |
| CN | 106793866 | A | 5/2017 |
| CN | 206714397 | | 12/2017 |
| CN | 207055161 | | 3/2018 |
| CN | 109259882 | A | 1/2019 |
| CN | 111713845 | A | 9/2020 |
| DE | 3241118 | A1 | 8/1984 |
| DE | 202005002964 | | 7/2005 |
| DE | 202006019788 | | 8/2007 |
| DE | 102006051649 | | 5/2008 |
| DE | 202015002964 | U1 | 8/2015 |
| EP | 0100975 | A2 | 2/1984 |
| EP | 0481553 | A1 | 4/1992 |
| EP | 2117395 | A2 | 11/2009 |
| EP | 2218559 | A1 | 8/2010 |
| EP | 3090646 | | 11/2016 |
| EP | 3381404 | A1 | 10/2018 |
| EP | 3501333 | A1 | 6/2019 |
| FR | 2835176 | | 8/2003 |
| GB | 766486 | | 1/1957 |
| GB | 2493409 | | 2/2013 |
| JP | 61020509 | | 1/1986 |
| JP | S63284262 | | 11/1988 |
| JP | H0669408 | | 3/1994 |
| JP | 2561978 | | 12/1996 |
| JP | 2619825 | | 6/1997 |
| JP | 2003009951 | | 1/2003 |
| JP | 2003245132 | | 9/2003 |
| JP | 2004089471 | | 3/2004 |
| JP | 2005053973 | | 3/2005 |
| JP | 4076405 | | 2/2008 |
| JP | 2009011621 | | 1/2009 |
| JP | 2011045621 | | 3/2011 |
| JP | 2011087747 | | 5/2011 |
| JP | 2015231500 | A | 12/2015 |
| JP | 6160619 | B2 | 6/2017 |
| JP | 3213325 | | 11/2017 |
| KR | 20070013844 | | 1/2007 |
| KR | 20090030829 | | 3/2009 |
| KR | 101142611 | | 5/2012 |
| KR | 20130006243 | U | 10/2013 |
| KR | 101339558 | | 12/2013 |
| KR | 200473116 | | 6/2014 |
| KR | 20150057308 | | 5/2015 |
| KR | 20150105813 | | 9/2015 |
| KR | 101591299 | | 2/2016 |
| KR | 20160125725 | | 11/2016 |
| KR | 20170062779 | | 6/2017 |
| KR | 101847473 | B1 | 4/2018 |
| KR | 200486759 | Y1 | 6/2018 |
| KR | 101987341 | B1 | 6/2019 |
| RU | 2141238 | | 11/1999 |
| WO | 9510959 | | 4/1995 |
| WO | 9838889 | | 9/1998 |
| WO | 9844823 | A2 | 10/1998 |
| WO | 2005002826 | A1 | 1/2005 |
| WO | 2005030002 | | 4/2005 |
| WO | 200641658 | | 4/2006 |
| WO | 2008098107 | A2 | 8/2008 |
| WO | 2009045982 | A1 | 4/2009 |
| WO | 2012126126 | | 9/2012 |
| WO | 2012144328 | | 10/2012 |
| WO | 2013076904 | | 5/2013 |
| WO | 2013101300 | A1 | 7/2013 |
| WO | 2013158741 | | 10/2013 |
| WO | 2014193621 | | 12/2014 |
| WO | 2015061651 | A1 | 4/2015 |
| WO | 2016189407 | A1 | 12/2016 |
| WO | 2017173768 | A1 | 10/2017 |
| WO | 2018025751 | | 2/2018 |
| WO | 2019072925 | A1 | 4/2019 |
| WO | 2019157787 | A1 | 8/2019 |

OTHER PUBLICATIONS

All Office Actions; U.S. Appl. No. 16/225,509, dated Dec. 19, 2018.
All Office Actions; U.S. Appl. No. 16/225,592, dated Dec. 19, 2018.
All Office Actions; U.S. Appl. No. 16/225,688, dated Dec. 19, 2018.
All Office Actions; U.S. Appl. No. 16/225,809, dated Dec. 19, 2018.
All Office Actions; U.S. Appl. No. 16/272,392, dated Feb. 11, 2019.
All Office Actions; U.S. Appl. No. 16/272,422, dated Feb. 11, 2019.
All Office Actions; U.S. Appl. No. 16/272,872, dated Feb. 11, 2019.
All Office Actions; U.S. Appl. No. 16/272,943, dated Feb. 11, 2019.
All Office Actions; U.S. Appl. No. 16/551,399, dated Aug. 26, 2019.
All Office Actions; U.S. Appl. No. 17/077,639, dated Oct. 22, 2020.
All Office Actions; U.S. Appl. No. 17/090,980, dated Jun. 11, 2020.
All Office Actions; U.S. Appl. No. 17/155,167, dated Jan. 22, 2021.
All Office Actions; U.S. Appl. No. 17/155,208, dated Jan. 22, 2021.
All Office Actions; U.S. Appl. No. 17/218,573, dated Mar. 31, 2021.
All Office Actions; U.S. Appl. No. 17/218,742, dated Mar. 31, 2021.
All Office Actions; U.S. Appl. No. 17/219,989, dated Apr. 1, 2021.
All Office Actions; U.S. Appl. No. 17/225,259, dated Apr. 8, 2021.
All Office Actions; U.S. Appl. No. 17/225,283, dated Apr. 8, 2021.
All Office Actions; U.S. Appl. No. 17/225,296, dated Apr. 8, 2021.
All Office Actions; U.S. Appl. No. 17/225,411, dated Apr. 8, 2021.
All Office Actions; U.S. Appl. No. 17/354,027, dated Jun. 22, 2021.
All Office Actions; U.S. Appl. No. 17/462,089, dated Aug. 31, 2021.
All Office Actions; U.S. Appl. No. 16/829,585, dated Mar. 25, 2020.
PCT Search Report and Written Opinion for PCTUS2019/047617 dated Oct. 2, 2019.
U.S. Appl. No. 17/462,089, dated Oct. 31, 2021, to first inventor et al.
All Office Actions; U.S. Appl. No. 17/511,103, filed Oct. 26, 2021.
All Office Actions; U.S. Appl. No. 17/517,928, filed Nov. 3, 2021.
All Office Actions; U.S. Appl. No. 17/517,937, filed Nov. 3, 2021.
All Office Actions; U.S. Appl. No. 17/517,957, filed Nov. 3, 2021.
All Office Actions; U.S. Appl. No. 17/517,975, filed Nov. 3, 2021.
All Office Actions; U.S. Appl. No. 17/517,990, filed Nov. 3, 2021.
All Office Actions; U.S. Appl. No. 17/517,999, filed Nov. 3, 2021.
All Office Actions; U.S. Appl. No. 17/518,009, filed Nov. 3, 2021.
Unpublished U.S. Appl. No. 17/511,103, filed Oct. 26, 2021, to first inventor et. al.
Unpublished U.S. Appl. No. 17/517,928, filed Nov. 3, 2021, to first inventor et. al.
Unpublished U.S. Appl. No. 17/517,937, filed Nov. 3, 2021, to first inventor et. al.
Unpublished U.S. Appl. No. 17/517,957, filed Nov. 3, 2021, to first inventor et. al.
Unpublished U.S. Appl. No. 17/517,975, filed Nov. 3, 2021, to first inventor et. al.
Unpublished U.S. Appl. No. 17/517,990, filed Nov. 3, 2021, to first inventor et. al.
Unpublished U.S. Appl. No. 17/517,999, filed Nov. 3, 2021, to first inventor et. al.
Unpublished U.S. Appl. No. 17/518,009, filed Nov. 3, 2021, to first inventor et. al.

* cited by examiner

HEAD FOR AN ORAL-CARE IMPLEMENT AND A KIT COMPRISING SUCH HEAD

FIELD OF THE INVENTION

The present disclosure is concerned with a head for an oral-care implement and a kit comprising such head and a handle.

BACKGROUND OF THE INVENTION

Oral-care implements, like manual and powered toothbrushes comprising a plurality of tufts composed of filaments are well known in the art. Generally, the tufts are attached to a mounting surface of a head intended for insertion into a user's oral cavity. A grip handle is usually attached to the head, which handle is held by the user during brushing. The head is either permanently connected or repeatedly attachable to and detachable from the handle.

Toothbrushes comprising a plurality of tufts wherein at least two tufts are inclined in different directions with respect to the mounting surface from which they extend are also known in the art. For example, a brush head of a toothbrush is known which has a head body and multiple tuft. The head body has a mounting surface and multiple mounting holes defined in the mounting surface. The tufts are mounted in the mounting holes and protrude in an inclined manner from the mounting surface of the head body. Two rows of tufts are inclined at the same inclined angle relative to the mounting surface of the head body. A further row of tufts is attached to the mounting surface between said two rows and is inclined in an opposite direction.

While toothbrushes comprising this type of tuft assembly clean the outer buccal face of teeth and interproximal areas adequately when used with a scrubbing brushing technique, i.e. when performing a horizontal forth and back movement along the line of teeth, they are not as suitable to be used with a different brushing technique.

In order to protect the gum line from gum recession which may be caused by aggressive forth and back brushing, dentists recommend nowadays to brush the teeth by using the so-called "Bass method", a circular brushing motion and/or to brush from the gums to the teeth, i.e. in a vertical, rather than in a horizontal direction.

The "Bass method" or "Bass brushing technique" is defined by the following:

The head of the toothbrush is held horizontally against the teeth with the bristles part-way on the gums. The brush head is then tilted to about a 45-degree angle, so that the bristles are pointing under the gum line. The toothbrush is moved in very short horizontal strokes so that the tips of the bristles stay in one place, but the head of the brush waggles back and forth. Alternatively, tiny circular motions can be performed. The "Bass brushing technique" allows the bristles to slide gently under the gum. The brush is then rolled of flicked so that the bristles move out from under the gum toward the biting edge of the tooth to move the plaque out from under the gum line.

A tuft assembly as discussed above, is however, not as well suited to provide adequate removal of plaque and debris from the gingival margin, interproximal areas, lingual surfaces and other hard to reach areas of the mouth if used with one of the newly recommended brushing techniques.

Further, a toothbrush comprising a tuft assembly as described above removes plaque and other debris on a relatively limited area only, if used with a scrubbing brushing technique, i.e. when performing a horizontal forth and back movement.

It is an object of the present disclosure to provide a head for an oral-care implement which provides improved cleaning properties, in particular with respect to interproximal and gingival marginal regions of teeth. It is also an object of the present disclosure to provide a kit comprising such head and a handle.

SUMMARY OF THE INVENTION

In accordance with one aspect, a head for an oral-care implement is provided, the head having an elongated mounting surface with an outer circumference, a longitudinal axis extending between a proximal end attached, or repeatedly attachable to and detachable from a handle, and a distal end opposite the proximal end, the head comprising:

two outer rows of tufts extending from the mounting surface along the longitudinal axis in proximity to the outer circumference, and an arc-shaped toe arranged at the distal end and being composed of filaments or a plurality of tufts of filaments arranged in an arc-shaped manner, the tufts of the outer rows having a longitudinal extension and a cross-sectional area extending substantially perpendicular to the longitudinal extension, the cross-sectional area having an elongated shape with a longer axis and a shorter axis, wherein the tufts of the outer rows are arranged in a manner that the longer axis defines an angle $\alpha$ of from about 20° to about 65°, preferably from about 30° to about 50°, more preferably about 45° with respect to the longitudinal axis of the head, so that the tufts of the outer rows and the arc-shaped toe define an outer arc-shaped envelope.

In accordance with one aspect, a kit comprising a handle and such a head is provided, the head being permanently attached, or repeatedly attachable to and detachable from the handle.

BRIEF DESCRIPTION OF THE DRAWINGS

The invention is described in more detail below with reference to an embodiment and figures, wherein.

DETAILED DESCRIPTION OF THE INVENTION

A head for an oral-care implement in accordance with the present disclosure has an elongated mounting surface surrounded by an outer circumference. A longitudinal axis extends between a proximal end and a distal end opposite the proximal end. At its proximal end the head may be either permanently attached to a handle, or it may be repeatedly attachable to and detachable from the handle.

The head comprises two outer rows of tufts which extend from the mounting surface along the longitudinal axis in close proximity to the outer circumference, respectively. Each tuft of the outer rows has a longitudinal extension extending from the mounting surface to its free end, and a cross-sectional area extending substantially perpendicular to the longitudinal extension. Said cross-sectional area has an elongated shape thereby defining a longer axis and a shorter axis. The tufts of the outer rows are arranged in a manner that the longer axis defines an angle $\alpha$ of from about 20° to about 65°, preferably from about 30° to about 50°, more preferably about 45° with respect to the longitudinal axis of the head.

In addition to the two outer rows of tufts, the head comprises an arc-shaped toe arranged at the distal end of the head. Said arc-shaped toe is composed either of a plurality of filaments arranged in an arc-shaped manner, or of a plurality of tufts comprising a plurality of filaments and the tufts being arranged in an arc-shaped manner "Arc-shaped" or "arc-shaped toe" is defined as a part of a curve having a convex portion which is closest to the distal end of the head. The arc-shaped toe may be crescent-shaped. Such crescent-shape may be defined by the enclosed area by two circular arcs of different diameters which intersect at two points, preferably in a manner that the enclosed area does not include the center of the original circle.

The tufts of the outer rows and the arc-shaped toe are arranged in a manner so that they define together an outer arc-shaped envelope.

Figure 5:
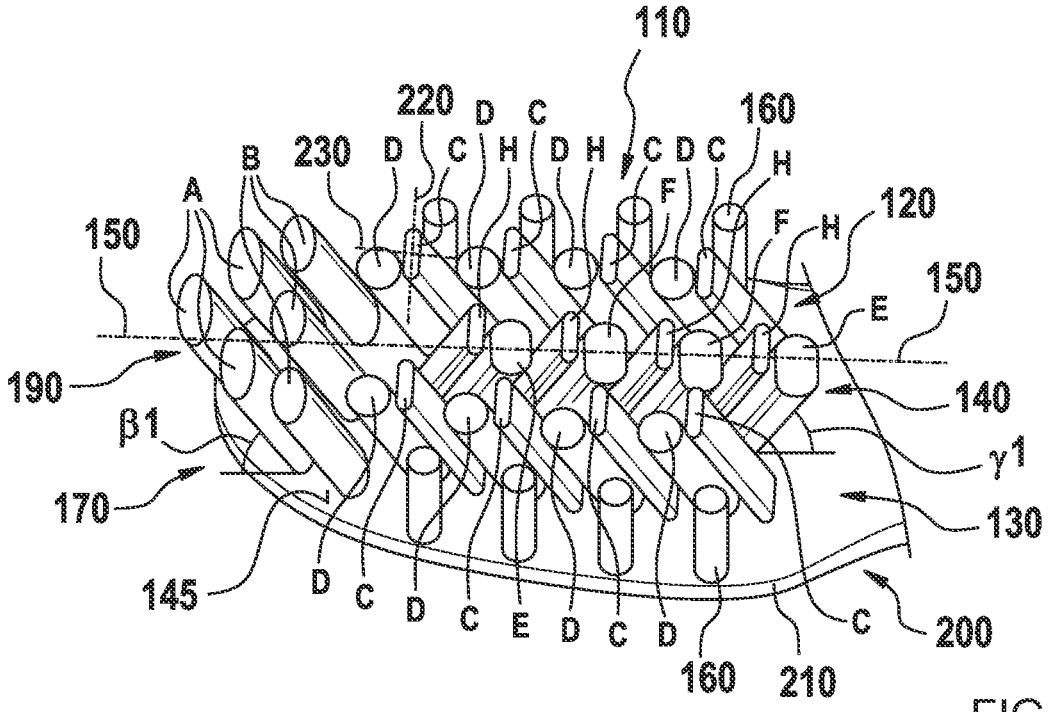
FIG. 5 shows an enlarged view of a portion of the head of FIG. 4.

Surprisingly, it was found out that a head according to the present disclosure demonstrates significant improved cleaning performance as compared to a brush head comprising the same tuft arrangement, but the tufts not being arranged to define an angle with respect to the longitudinal axis of the head (cf. FIG. 5). Test results (cf. FIG. 6) clearly showed that a brush head according to the present disclosure provides significant improved plaque removal properties with respect to buccal surfaces, lingual surfaces, occlusal surfaces, the gum line and interdental areas as compared to a head having the same tuft arrangement, but not being arranged in the angled manner according to claim 1.

Such improved brushing and plaque removal performance is achieved as the specific tuft arrangement of the outer rows lead to an additional sideward motion of the outer filaments. When the brush head is pushed forward, the filaments of the tufts of the outer rows spread out to a significantly wider footprint as in their initial position. In contrast to that, when the brush head is pulled backwards the filaments get together to the inner field. During a forth and back brushing action, the direction of motion changes with every stroke, thereby providing a pulsing outward/inward motion of the filaments with every stroke of the brush. Such pulsing outward/inward motion of the filaments leads to an active adaptation of the filaments to the tooth contour and gum line. The active sideward motion drives the filaments to clean even in the gingival pockets, i.e. below the gum line. By means of a transparent teeth model it was demonstrated that the filaments penetrate into the gingival pockets and "whip out" the pockets and deliver an intensive cleaning. A brush head as described above and shown in FIG. 5 does not show this type of action. The filaments stay substantially in the same configuration, independent of a forward or backward motion.

The head according to the present disclosure provides improved cleaning performance when used with every kind of brushing style, e.g. if used with a scrubbing brushing technique, i.e. when performing a horizontal forth and back movement along the line of teeth, if used with the "Bass method", when a circular brushing motion is performed and/or when a user brushes from the gums to the teeth, i.e. in a vertical, rather than in a horizontal direction.

The tufts of the outer rows and/or the arc-shaped toe may be inclined with respect to the mounting surface by an inclination angle $\beta$ from about 65° to about 80°, preferably from about 70° to about 80°, further preferably from about 74° to about 78°, even further preferably from about 74° to about 75°. In other words, the tufts may be oriented at an angle $\beta$ relative to that portion of the mounting surface of the head from which it extends. The tuft may be angled relative to an imaginary line which is tangent to or co-planar with the mounting surface of the head through which the tuft is secured to the head. The tufts may be oriented at an angle $\beta$ in a direction that is substantially parallel to the longitudinal extension of the head thereby providing even further improved cleaning properties, in particular with respect to interdental areas, as the inclination of the tuft may facilitate that the filaments slide into small gaps between the teeth to clean the interdental areas more easily.

Experiments revealed that filaments having an inclination angle $\beta$ from about 65° to about 80°, optionally from about 70° to about 80° are more likely to penetrate into interdental gaps. Filaments having an inclination angle $\beta$ of more than about 80° showed low likelihood of interdental penetration as these filaments bend away from the direction of travel or skip over the teeth. Surprisingly, it was found, that filaments having an inclination angle $\beta$ from about 74° to about 76°, optionally about 74° or about 75° may further improve cleaning performance of the head for an oral-care implement. Experiments revealed that such filaments are even more likely to penetrate into interdental gaps.

The tufts of the outer rows and/or the arc-shaped toe may be inclined in a direction towards the distal end. When the head of the oral-care implement is moved in a forward motion along its longitudinal extension, the filaments being inclined in the direction towards the distal end of the head may perform a poke, pivot and slide motion thereby penetrating into interproximal areas from a forward direction.

Optionally, a distance/spacing between the tufts within one row may be adapted/correspond to the width of the teeth. This may allow synchronized penetration of the filaments into multiple interproximal areas/interdental spaces. As the width of the teeth may vary with the position of the jaws and from one person to the other, a distance/spacing between the tufts within a row may be in the range from about 3 mm to about 6 mm.

The head may further comprise two inner rows of tufts extending from the mounting surface, the tufts of the inner rows having a longitudinal extension and a cross-sectional area extending substantially perpendicular to the longitudinal extension. The cross-sectional area may have an elongated shape thereby defining a longer axis and a shorter axis. The tufts of the inner rows may be arranged in a manner that the longer axis is substantially parallel to the longitudinal axis of the head thereby providing stronger scaping effects on the tooth surface. As the inner rows of tufts are usually not in direct contact with the gums, the stronger scraping effects on the teeth may have no negative impact on the soft tissue in the mouth.

The tufts of the inner rows may be inclined with respect to the mounting surface by an inclination angle γ from about 60° to about 85°, preferably from about 70° to about 80°, further preferably about 80°. Generally, the stiffness of a tuft depends on the filament diameter and the length of a tuft. With an inclination of a tuft the length of a tuft increases and the stiffness decreases. Consequently, as the tuft pattern of the head according to the present disclosure may comprise tufts being inclined by different angles, this results in different stiffness of the respective rows. The outer rows may define an angle β from about 65° to about 80°, preferably from about 70° to about 80°, further preferably from about 74° to about 78°, even further preferably from about 74° to about 75°, and are, thus, relatively soft in order to clean gently along the (sensitive) gum-line. In contrast thereto, the inner rows may define an angle γ from about 60° to about 85°, preferably from about 70° to about 80°, further preferably about 80°, and are, thus, stiffer than the outer rows to allow a sufficient cleaning on the teeth surface.

The tufts of the inner rows may be inclined in a direction towards the proximal end of the head. As the inclination of the tufts may facilitate that the filaments can slide into interdental areas/spaces in the direction of inclination more easily, the head having rows of tufts which are inclined in opposite directions may improve cleaning properties when the head is moved in said opposite directions. In case the head is moved along its longitudinal extension on the teeth surface, the filaments of the at least two tufts may be forced to penetrate into the interdental spaces in a forward and backward brushing motion, respectively. When the head of the oral-care implement is moved in a forward motion along its longitudinal extension, the filaments being inclined in the direction towards the distal end of the head may perform a poke, pivot and slide motion thereby penetrating into interproximal areas from a forward direction. When the head is moved in a backward motion, i.e. in the opposite direction of the forward motion, the filaments being inclined in the direction towards the proximal end of the head may perform the poke, pivot and slide motion thereby penetrating into interproximal areas from the backward direction. Thus, a criss-cross tuft pattern is provided allowing that the filaments penetrate into interproximal areas with every single forward and backward brushing stroke along the occlusal, buccal and lingual surfaces of the teeth.

The stiffness of the tufts of the inner rows may be higher than the stiffness of the tufts of the outer rows. The lower stiffness of the tufts of the outer rows may provide a gentle cleaning action thereby protecting the gums; a stinging sensation or unpleasant feeling on the gums during brushing is substantially avoided.

The outer rows of tufts and the arc-shaped toe may be composed of filaments having a substantially circular cross-sectional area, and the inner rows of tufts may be composed of filaments having a cross-shaped cross-sectional area. The cross-shaped cross-sectional area comprises four projections and four channels being arranged in an alternating manner A tuft composed of cross-shaped filaments possesses a relatively low packing factor as compared to tufts composed of circular shaped filaments. In the context of this disclosure the term "packing factor" is defined as the total sum of the transverse cross-sectional areas of the filaments in a tuft hole divided by the transverse cross-sectional area of the tuft hole. In embodiments where anchors, such as staples, are used to mount the tuft within the tuft hole, the area of the anchoring means is excluded from the transverse cross-sectional area of the tuft hole.

The tufts of the inner rows may be provided with a packing factor within a range from about 40% to about 55%, or within a range from about 45% to about 50%. A packing factor of about 40% to about 55%, or from about 45% to about 50%, or about 49% opens up a specific void volume within the tuft while the filaments have still contact to each other along a portion of the outer lateral surface. The void volume may deliver more toothpaste to the tooth brushing process, and the toothpaste can interact with the teeth for a longer period of time which contributes to improved tooth brushing effects. In addition, the void volume, i.e. the space between filaments, enables increased uptake of loosened plaque due to improved capillary action. In other words, such low packing factor may result in more dentifrice/toothpaste retaining at/adhering to the filaments for a longer period of time during a tooth brushing process. Further, the lower tuft density may avoid that the dentifrice spread away which may result in an improved overall brushing process. Toothpaste can be better received in the cannels and, upon cleaning contact with the teeth, directly delivered, whereby a greater polishing effect is achieved, which is desirable, in particular for removal of tooth discoloration.

Further, due to the cross-shaped geometry of the filament, each single filament is stiffer than a circular-shaped filament, when made of the same amount of material. However, due to the low packing factor within a range from about 40% to about 55%, or from about 45% to about 50%, or about 49%, the stiffness of the overall tuft made of cross-shaped filaments is reduced as compared to a tuft of circular-shaped filaments. Surprisingly, it has been found out that such tuft provides improved sensory experience, i.e. a softer feeling within the mouth during brushing, while providing increased cleaning efficiency. The projections of the cross-shaped filaments can easily enter the gingival groove and other hard to reach areas, e.g. interproximal tooth surfaces, scratch on the surfaces to loosen the plaque, and due to the improved capillary effects of the overall tuft, the plaque can be better taken away.

The head may further comprise a middle row of tufts extending from the mounting surface, e.g. in a substantially straight manner—in other words, the tufts of the middle row are not inclined with respect to the mounting surface. The tufts of the middle row may possess the highest stiffness to allow a precise guidance of the head of the oral-care implement during brushing without harming sensitive areas in the mouth.

The tufts of the middle row have a longitudinal extension and a cross-sectional area extending substantially perpendicular to the longitudinal extension. The cross-sectional area may have an elongated shape defining a longer axis and a shorter axis. These tufts may be arranged along a center axis between the inner rows in a manner that the longer axis of the elongated cross-sectional area is substantially parallel to the longitudinal axis of the head to provide further improved guidance of the head during brushing.

The tuft pattern of the head may have a topography, i.e. trim, where the outer rows including the arc-shaped toe form a single arc, while the middle and inner rows form a double arc.

The tufts may be attached to the head by means of a hot-tufting process. One method of manufacturing the oral-care implement may comprise the following steps: In a first step, tufts may be formed by providing a desired amount of filaments. In a second step, the tufts may be placed into a mold cavity so that ends of the filaments which are supposed to be attached to the head extend into said cavity. The opposite ends of the filaments not extending into said cavity may be either end-rounded or non-end-rounded. For example, the filaments may be not end-rounded in case the filaments are tapered filaments having a pointed tip. In a third step the head or an oral-care implement body comprising the head and the handle may be formed around the ends of the filaments extending into the mold cavity by an injection molding process, thereby anchoring the tufts in the head. Alternatively, the tufts may be anchored by forming a first part of the head—a so called "sealplate"—around the ends of the filaments extending into the mold cavity by an injection molding process before the remaining part of the oral-care implement is formed. Before starting the injection molding process the ends of the tufts extending into the mold cavity may be optionally melted or fusion-bonded to join the filaments together in a fused mass or ball so that the fused masses or balls are located within the cavity. The tufts may be held in the mold cavity by a mold bar having blind holes that correspond to the desired position of the tufts on the finished head of the oral-care implement. In other words, the tufts attached to the head by means of a hot tufting process may be not doubled over a middle portion along their length and may be not mounted in the head by using an anchor/staple. The tufts may be mounted on the head by means of an anchor free tufting process.

The oral-care implement may be a toothbrush kit comprising a handle and a head according to any of the embodiments described above. The head extends from the handle and may be repeatedly attachable to and detachable from the handle. The head may be attachable to the handle via a snap-fit locking mechanism. For example, the handle may comprise a connector which may be insertable into a hollow portion in the head, or the head may comprise a connector insertable into a hollow portion in the handle. Alternatively, a connector may be provided as a further, i.e. separate part of the oral-care implement. Such connector may be insertable into a hollow portion in the handle and into a hollow portion the head, respectively, thereby providing a sufficiently strong connection and stability between the head and the handle to enable a user to perform a brushing action.

Alternatively, the head may be non-detachably connected to the handle. The toothbrush may be an electrical or a manual toothbrush.

If the oral-care implement is a kit comprising a head being repeatedly attachable to and detachable from the handle, the head may be made from a non-magnetic and/or non-ferromagnetic material, while the handle may be at least partially made from a magnetic and/or ferromagnetic material. For example, the head may be injection molded from a thermoplastic polymer, e.g. polypropylene. The magnetic and/or ferromagnetic material forming at least a part of the handle may comprise an amorphous thermoplastic resin. The magnetic and/or ferromagnetic material may further comprise aluminum oxide, boron nitride or aluminum silicate. Furthermore, the magnetic and/or ferromagnetic material may comprise in addition or alternatively iron oxide. The magnetic and/or ferromagnetic material may further comprise glass fibers which may be pre-mixed with at least a portion of the amorphous thermoplastic resin.

Such magnetic/ferromagnetic material of the handle has a higher density as the non-magnetic/ferromagnetic material of the head. Usually, users are accustomed that products, in particular in the personal health care sector, have a specific weight that guarantees high product quality and provides comfortable feeling during use of the product. As the magnetic/ferromagnetic material of the handle possesses a relatively high density, and, thus, a relatively heavy weight, such handle provides the oral-care implement with afore mentioned benefits.

Moreover, the magnetic/ferromagnetic material of the handle allows for hygienic storage of the oral-care implement. For example, the oral-care implement can be magnetically attached to a magnetic holder. Remaining water, toothpaste slurry and saliva can drain off from the brush. Consequently, the overall oral-care implement can dry relatively quickly, and bacteria growth can significantly be reduced, thereby rendering the oral-care implement more hygienic. In contrast to a common toothbrush being stored in a toothbrush beaker where drained fluids get collected and accumulated at the bottom of the beaker, the brush according to the present disclosure is exposed to wet conditions over a significantly shorter period of time.

The following is a non-limiting discussion of an example embodiment of a head for an oral-care implement in accordance with the present disclosure, where reference to the Figures is made.

Figure 1:
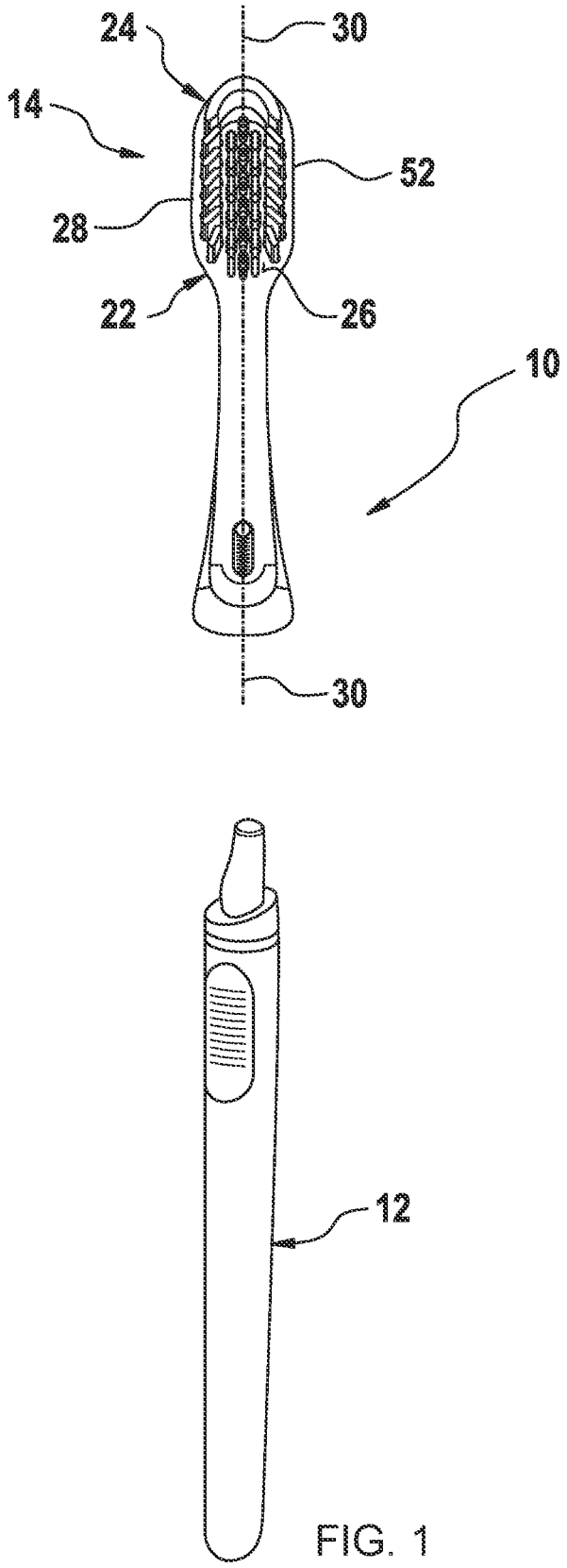
FIG. 1 shows a schematic view of a kit comprising an embodiment of a head and a handle.
Figure 2:
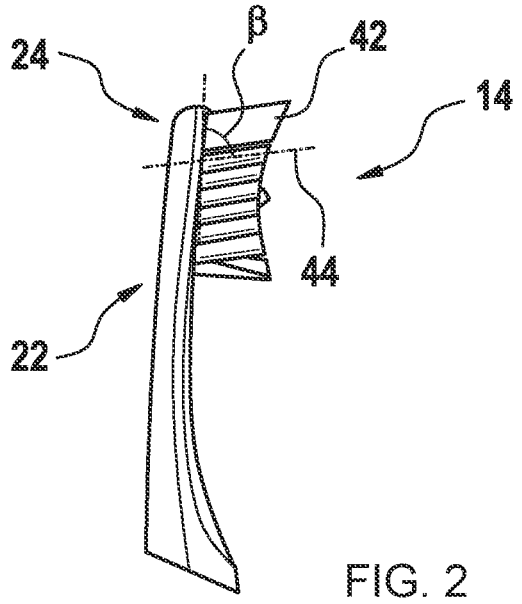
FIG. 2 shows a schematic side view of the head of FIG. 1.
Figure 3:
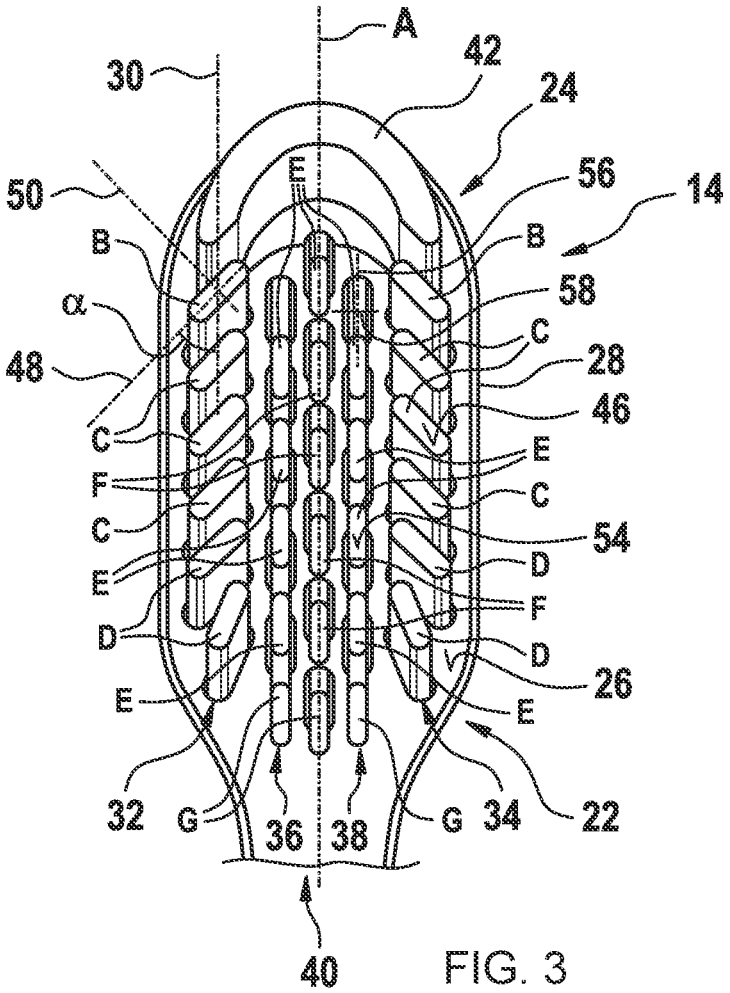
FIG. 3 shows an enlarged view a portion of the head of FIG. 1.

FIGS. 1 to 3 show an embodiment of an oral-care implement 10, which could be a manual or an electrical toothbrush 10 comprising a handle 12 and a head 14, the head 14 being repeatedly attachable to and detachable from the handle 12. The head 14 has a proximal end 22 close to the handle 12 and a distal end 24 furthest away from the handle 12, i.e. opposite the proximal end 22. The head 14 has an elongated mounting surface 26 from which several tufts of filaments extend. The mounting surface 26 is surrounded by an outer circumference 28. A longitudinal axis 30 extends between the proximal end 22 and the distal end 24. As shown in FIG. 3, there are two outer rows of tufts 32, 34, two inner rows of tufts 36, 38 and a middle row of tufts 40 extending from the mounting surface 26 of the head 14 along the longitudinal axis 30. An arc-shaped toe 42 composed of filaments is attached at the distal end 24 of the head 14. Alternatively, the arc-shaped toe 42 may be composed of a number of filament tufts, the tufts being arranged in an arc-shaped manner and spaced at minimum distance to create the appearance of one elongated tuft. All tufts may be secured to the head 14 by means of a hot tufting process.

As shown in FIG. 3, the outer rows of tufts 32, 34 are fixed on the mounting surface 26 in close proximity to the outer circumference 28. The tufts of the outer rows 32, 34 have a longitudinal extension 44 and a cross-sectional area 46 extending substantially perpendicular to the longitudinal extension 44. The cross-sectional area 46 has an elongated shape defining a longer axis/extension 48 and a shorter axis/extension 50. The tufts of the outer rows 32, 34 are arranged in a manner that the longer axis 48 of the elongated cross-sectional area 46 defines an angle $\alpha$ of about 45° with respect to the longitudinal axis 30 of the head 14. Alternatively, the angle $\alpha$ may be from about 20° to about 65°, preferably from about 30° to about 50°. The tufts of the outer rows 32, 34 and the arc-shaped toe 42 define together an outer arc-shaped envelope 52 (cf. FIG. 1).

The tufts of the outer rows 32, 34 and the arc-shaped toe 42 are inclined with respect to the mounting surface in a direction towards the distal end 24 of the head 14 by an inclination angle $\beta$ from about 74° to about 75°. Alternatively, the inclination angle $\beta$ may be from about 65° to about 80°, preferably from about 70° to about 80°, further preferably from about 74° to about 78°.

The tufts of the inner and middle rows 36, 38, 40 have also a cross-sectional area 54 being elongated thereby defining a longer axis/extension 56 and a shorter axis/extension 58.

The tufts of the inner and middle rows 36, 38, 40 are arranged in a manner that the longer axis is substantially parallel to the longitudinal axis 30 of the head 14. The tufts of the inner rows 36, 38 are inclined with respect to the mounting surface 26 in a direction towards the proximal end 22 by an inclination angle γ of about 80°. Alternatively, the inclination angle γ may be from about 60° to about 85°, or from about 70° to about 80°. The tufts of the middle row 40 extend from the mounting surface 26 in a substantially straight manner, i.e. they are not inclined in any direction.

While the tufts of the outer rows 32, 34 and the arc-shaped toe 42 may be composed of filaments having a substantially circular cross-sectional area, the tufts of the inner and middle rows 36, 38, 40 may be composed of filaments having a cross-shaped cross-sectional area. The stiffness of the tufts of the inner and middle rows 36, 38, 40 is higher than the stiffness of the tufts of the outer rows 32, 34.

Figure 4:
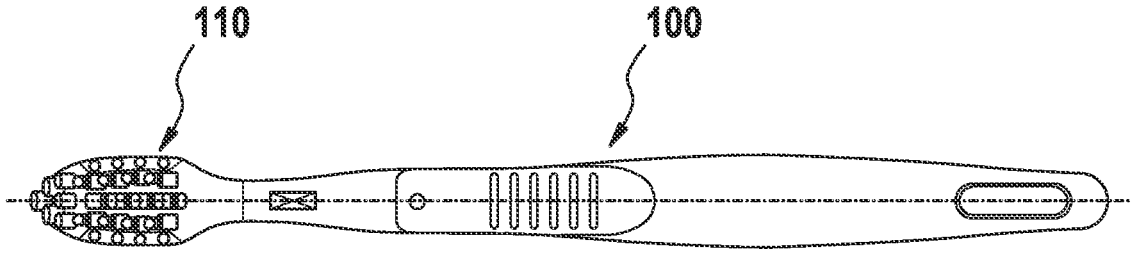
FIG. 4 shows a schematic top-down view of a comparative example embodiment of an oral-care implement comprising a head and a handle.

FIGS. 4 and 5 show a toothbrush 100 comprising a head 110 according to the state of the art. Three rows of tufts 120, 130, 140 extending from mounting surface 145 along a longitudinal extension 150 of the head 110 are arranged in a criss-cross pattern. An arc-shaped toe 170 is located at the distal end 190 of the head 110, the arc-shaped toe 170 being composed of six filament tufts, the tufts being arranged in an arc-shaped manner. The outer rows of tufts 120, 130 as well as the tufts of the arc-shaped toe 170 are inclined in a direction towards the distal end 190 of the head 110 by an inclination angle $\beta_1$ of about 74° to about 75°, while the inner row of tufts 140 is inclined in the opposite direction, i.e. towards the proximal end 200 by an inclination angle $\gamma_1$ of about 74° to about 75°.

Each row of tufts 120, 130, 140 is composed of tufts having circular and elongated cross-sectional shapes, the elongated cross-sectional shape being defined by a longer axis 220 and a shorter axis 230. The different type of tufts are arranged along the longitudinal extension 150 of head 110 in an alternating manner. All tufts having an elongated cross-sectional shape are arranged on the head 110 in a manner that the longer axis 220 is substantially perpendicular to the longitudinal extension 150 of the head 110.

Elastomeric elements 160 having a substantially circular cross-sectional area for massaging the gums are arranged at the outer circumference 210 of the head 110.

COMPARISON EXPERIMENTS

Robot Tests:

A head for an oral-care implement in accordance with the present disclosure (example embodiment 1 of the present disclosure, cf. FIGS. 1 to 3) and a head for an oral-care implement according to a comparative example (comparative example 2 according to FIGS. 4 and 5) were compared with respect to their efficiency of plaque substitute removal on artificial teeth (typodonts).

Example Embodiment 1 of the Present Disclosure

The tuft pattern of example embodiment 1 is shown in FIG. 3; tuft and filament characteristics are listed in Table 1.

TABLE 1

| Tuft | Tuft dimension | inclination angle/ inclination direction | Filament diameter | Filament shape | Filament material |
|---|---|---|---|---|---|
| A (arc-shaped toe 42) | Width: 1.5 mm | 74°/distal end | 0.178 mm (7 mil) | circular | PA6.12 |
| All tufts of outer rows 32, 34 | 3.1 mm × 1.0 mm | 74°/distal end | 0.178 mm (7 mil) | circular | PA6.12 |
| E (all tufts of inner rows 36, 38) | 2.5 mm × 0.8 mm | 80°/proximal end | 0.269 mm (diagonal) | Cross-shaped | PBT |
| All tufts of middle row 40 | 2.5 mm × 0.8 mm | 80°/proximal end | 0.269 mm (diagonal) | Cross-shaped | PBT |
| G | 3.0 mm × 1.0 mm | 80°/proximal end | 0.178 mm (7 mil) | circular | PA6.12 |

Comparative Example 1

The tuft pattern of comparative example 2 is shown in FIG. 5; tuft and filament characteristics are listed in Table 2.

TABLE 2

| Tuft | Tuft dimension | inclination angle/ inclination direction | Filament diameter | Filament shape | Filament material |
|---|---|---|---|---|---|
| A | 3.4 mm × 1.4 mm | 74°/distal end | 0.152 mm (6 mil) | circular | PA6.12 |
| B | 2.7 mm × 1.4 mm | 74°/distal end | 0.152 mm (6 mil) | circular | PA6.12 |
| C | 2.4 mm × 0.8 mm | 74°/distal end | 0.152 mm (6 mil) | circular | PA6.12 |
| D | Ø1.9 mm | 74°/distal end | 0.178 mm (7 mil) | circular | PA6.12 |
| E | 2.5 mm × 1.9 mm | 74°/proximal end | 0.152 mm (6 mil) | circular | PA6.12 |
| F | 3.0 mm × 1.9 mm | 74°/proximal end | 0.152 mm (6 mil) | circular | PA6.12 |

TABLE 2-continued

| Tuft | Tuft dimension | inclination angle/ inclination direction | Filament diameter | Filament shape | Filament material |
|---|---|---|---|---|---|
| H | 2.4 mm × 0.8 mm | 74°/proximal end | 0.152 mm (6 mil) | circular | PA6.12 |

Brushing tests were performed using a robot system KUKA 3 under the following conditions (cf. Table 3):

TABLE 3

| Product | program upper jaw | program lower jaw | force | power supply |
|---|---|---|---|---|
| All tested products | EO_INDI | EU_INDI | 3 N | no |
| total cleaning time | 60 s | 60 s | | |
| program version | 9.11.09 Eng | 9.11.09 Eng | | |
| SYSTEC speed | 60 | 60 | | |
| SYSTEC amplitude x/y | 20/0 | 20/0 | | |
| number of moves | 3 | 3 | | |
| Movement | | horizontal | | |
| used handle/mould | | No/no | | |

Figure 6:
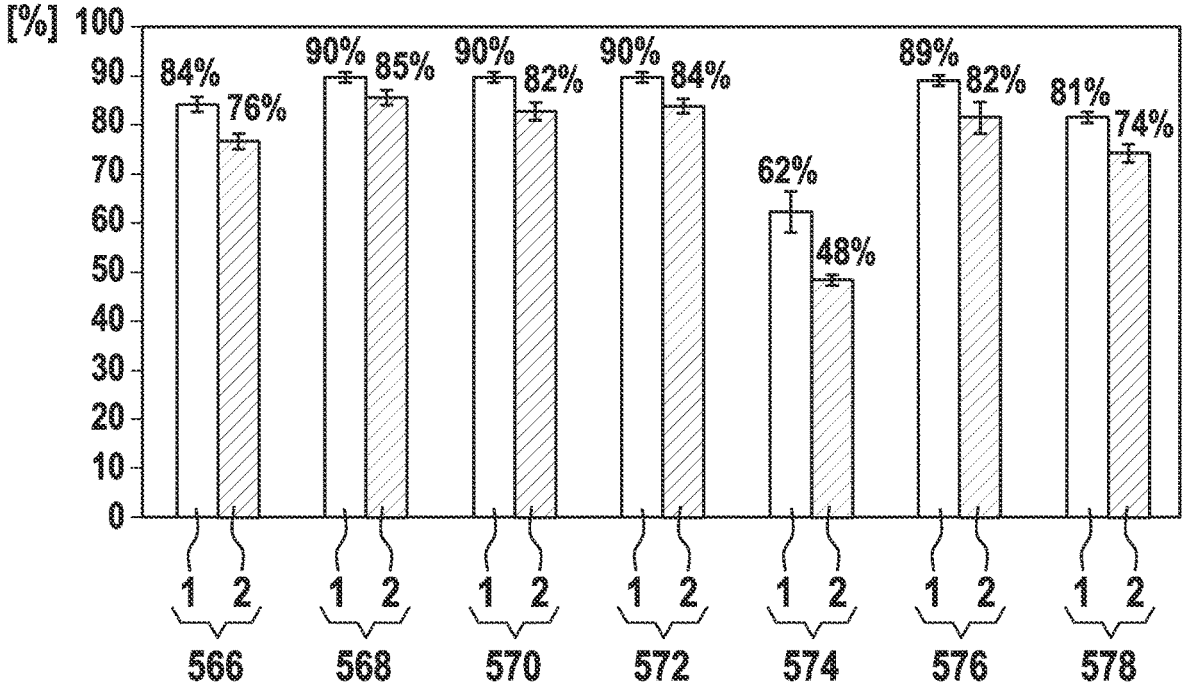
FIG. 6 shows a diagram in which brushing results of a head according to an example embodiment are compared with brushing results of a head according to a comparative example embodiment.
Figure 7A:
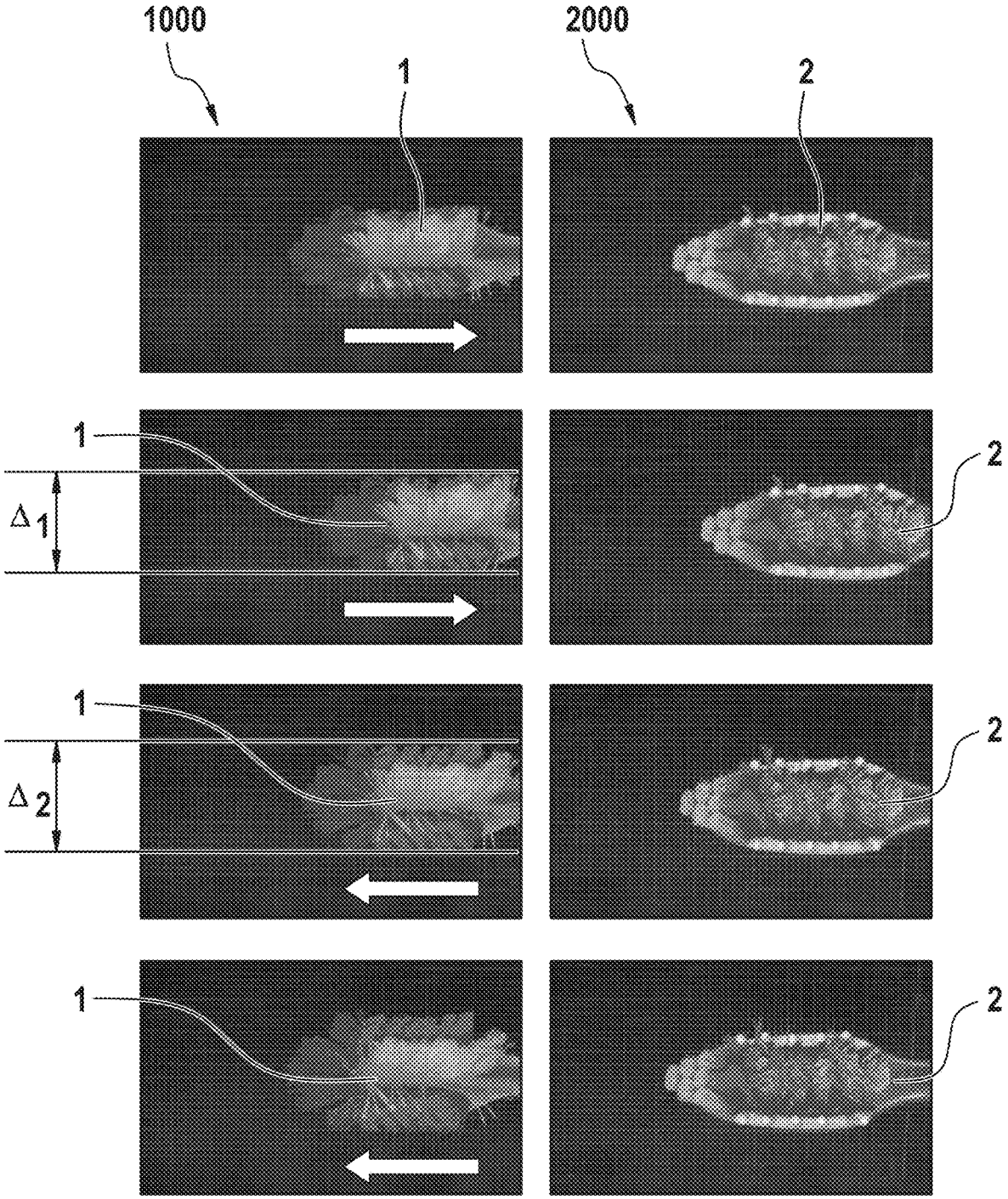
FIGS. 7A-7C show the foot print of the bristle pattern of a head of an example embodiment and a head of a comparative example embodiment, respectively, during a forth and back brushing motion.
Figure 7B:
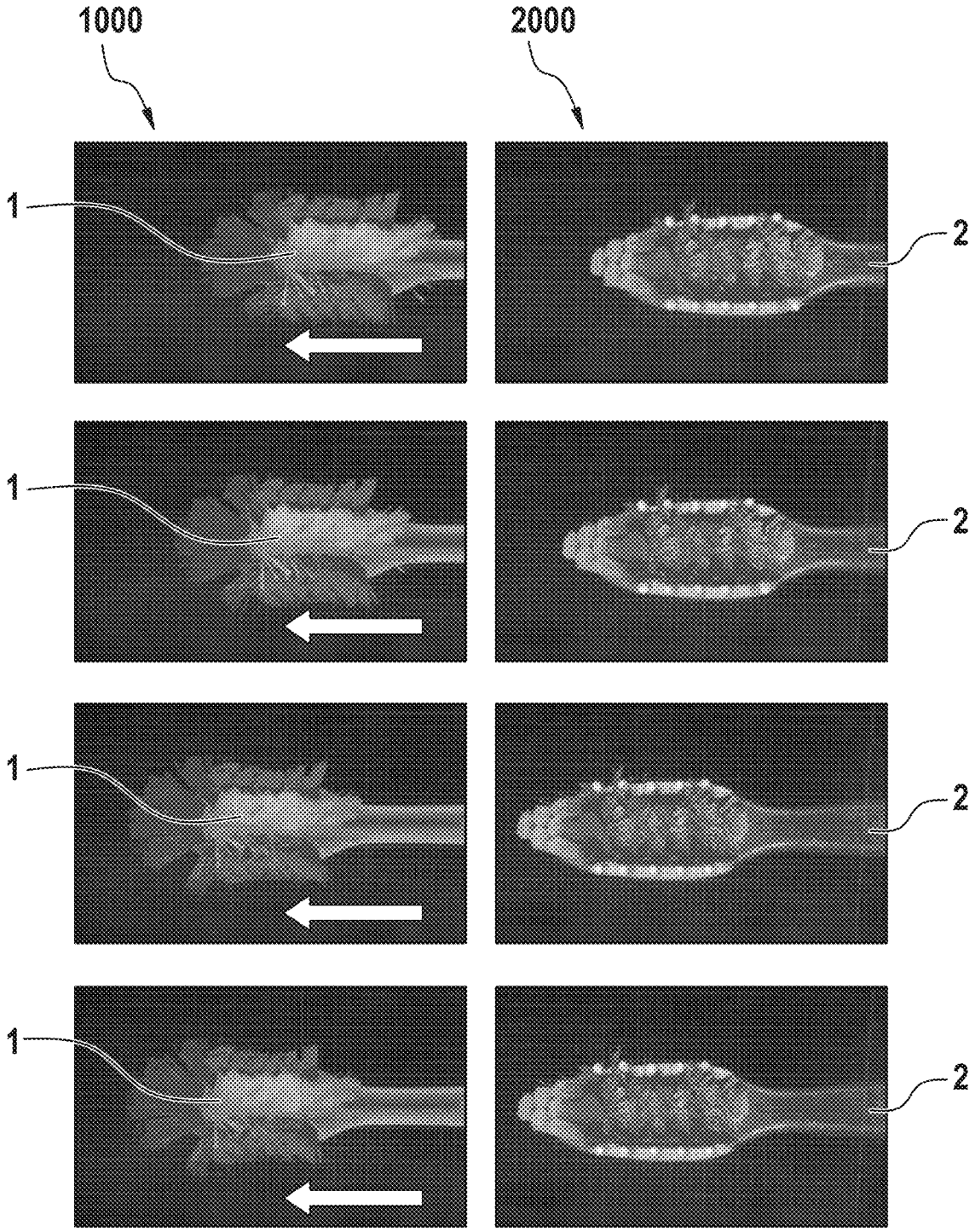
Figure 7C:
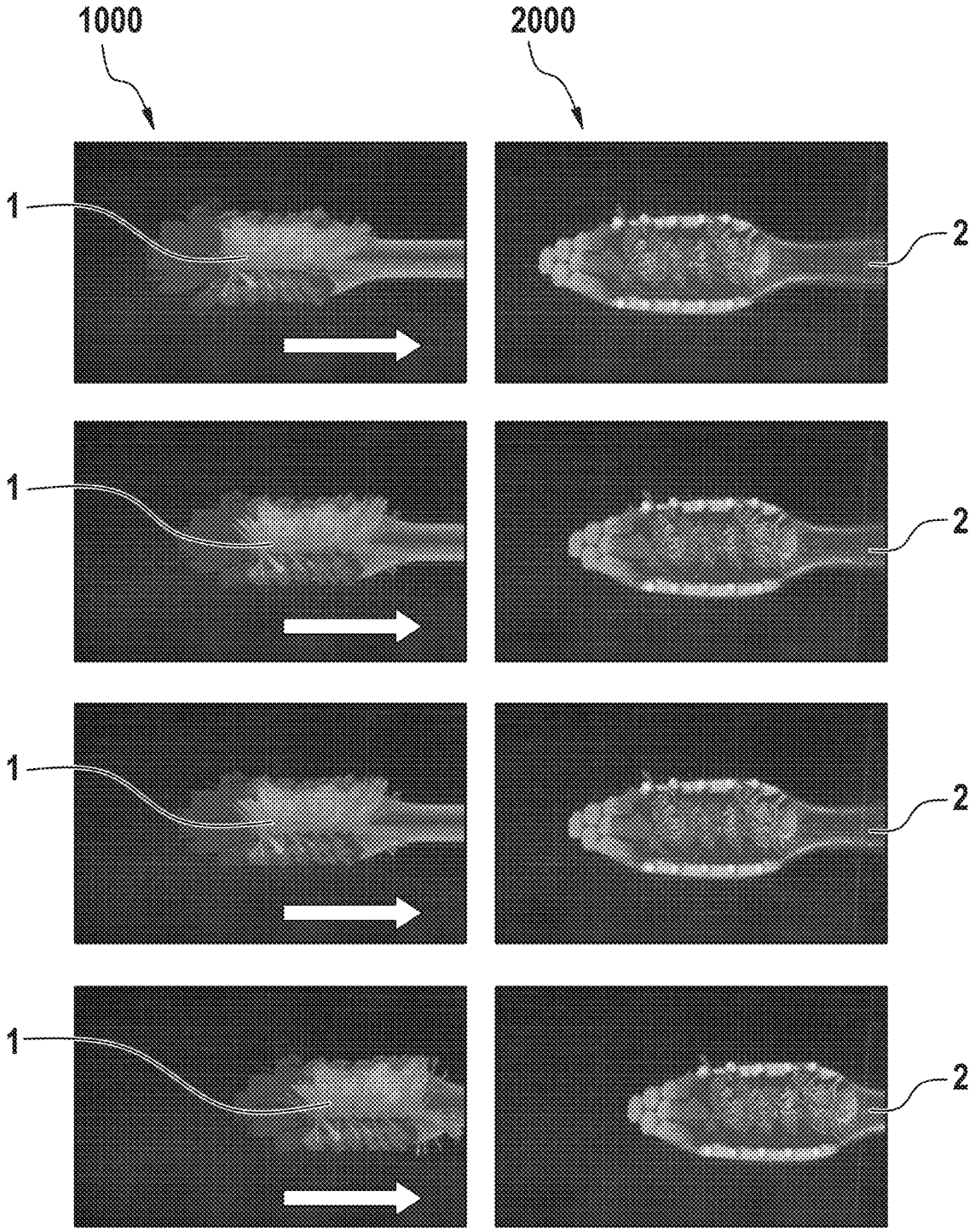
Figure 8:
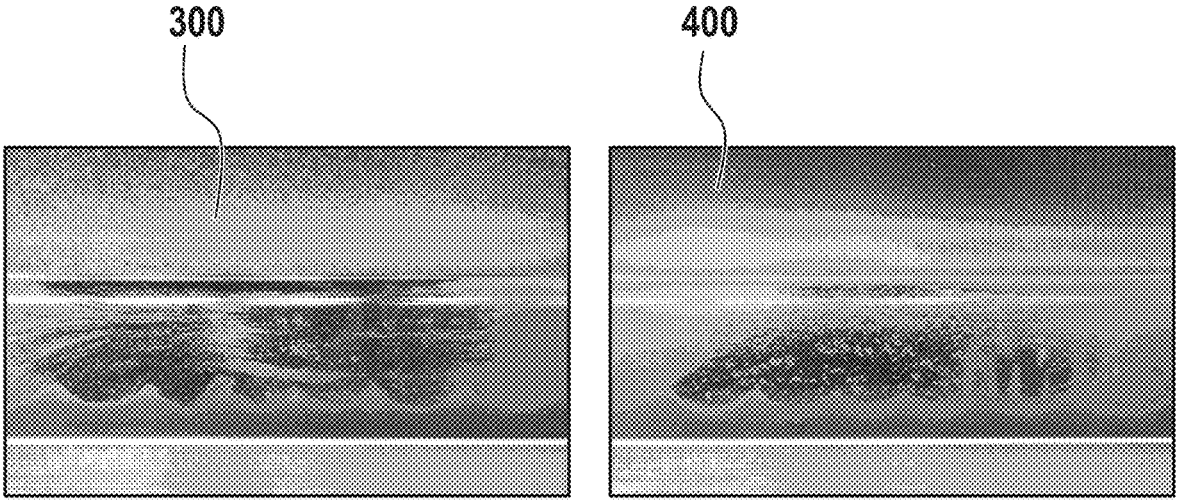
FIG. 8 visualizes cleaning results after brushing along an artificial gum line with a head of an example embodiment and a head of a comparative example embodiment, respectively.

FIG. 6 shows the amount of plaque substitute removal in % of the example embodiment 1 and the comparative example 2, each with respect to all tooth surfaces 566, buccal surfaces 568, lingual surfaces 570, lingual and buccal surfaces 572, occlusal surfaces 574, the gum line 576 and interdental surfaces 578.

FIG. 6 clearly shows that example embodiment 1 provides significant improved plaque removal properties with respect to all tooth surfaces 566, buccal surfaces 568, lingual surfaces 570, lingual and buccal surfaces 572, occlusal surfaces 574, the gum line 576 and interdental surfaces 578 compared to comparative example 2.

With reference to the above examples, the foot print of the bristle pattern of example embodiment 1 and of comparative embodiment 2, respectively, can be examined during a forth and back brushing motion. The heads of example embodiment 1 and comparative embodiment 2 are pressed onto a glass plate with 5N during brushing, and screenshots from high speed video are taken. Column 1000 shows the foot print of example embodiment 1, and column 2000 shows the foot print of comparative embodiment 2 in consecutive order. A grid on the backside of the glass plate serves as a means to quantify the sideward movement of the tufts of the outer rows. With a change of the movement direction (from backwards to forwards) the foot print of the tuft pattern of example embodiment 1 increases by 6 mm (form $\Delta_1$=13 mm to $\Delta_2$=19 mm), while the foot print of the tuft pattern of comparative embodiment 2 remains substantially constant.

The specific arrangement of the tufts of the outer rows of example embodiment 1 leads to a sideward motion of these tufts. When the brush head is pushed forward, the side tufts spread out to a significantly wider foot print $\Delta_2$ as in the initial position. In contrast thereto, when the brush head is pulled backwards the filaments get together to the inner field. During a normal use of the toothbrush during brushing, the direction of motion changes with every stroke. With every stroke an active outward/inward motion of the tufts can be observed that leads to an active adaptation of the filaments to the tooth contour and gum-line. The sideward motion enables an active adaptation onto the gum-line, that is a considered as a hard to reach area with significant influence on the overall oral health. The tuft pattern of comparative embodiment 2 did not show this kind of action. The tufts stay substantially in the same configuration, independent of forward or backward motion.

Further examination shows the improved cleaning performance of example embodiment 1 versus comparative embodiment 2 along an artificial gum line. The filaments of the tuft pattern of example embodiment 1 actively adapt to the contour of the gum line and, thus, brush much more thoroughly than a brush according to comparative embodiment 2. The active sideward motion of example embodiment 1 drives the filaments to clean even in the gingival pocket, i.e. below the gum line. The improved gum line cleaning effects are also derivable from FIG. 6. By means of a transparent teeth model, it can be shown that the outer filament tufts of example embodiment 1 "whip out" the gum pockets and deliver intensive cleaning effect.

In the context of this disclosure, the term "substantially" refers to an arrangement of elements or features that, while in theory would be expected to exhibit exact correspondence or behavior, may, in practice embody something slightly less than exact. As such, the term denotes the degree by which a quantitative value, measurement or other related representation may vary from a stated reference without resulting in a change in the basic function of the subject matter at issue.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

What is claimed is:

1. A head (14) for an oral-care implement (10), the head (14) comprising an elongated mounting surface (26) having an outer circumference (28), a longitudinal axis (30) extending between a proximal end (22) structured and configured to be removably attached to a handle (12), and a distal end (24) opposite to the proximal end (22), the head (14) comprising:

two outer rows of tufts (32, 34) extending from the mounting surface (26) along the longitudinal axis (30) in proximity to the outer circumference (28), and an arc-shaped toe (42) arranged at the distal end (24) and composed of filaments or a plurality of tufts of filaments arranged in an arc-shaped manner, the tufts of the outer rows (32, 34) having a longitudinal extension (44) and a cross-sectional area (46) extending substantially perpendicular to the longitudinal extension (44), the cross-sectional area (46) having an elongated shape with a longer axis (48) and a shorter axis (50), wherein the longer axis (48) defines an angle α of from about 20° to about 65° with respect to the longitudinal axis (30) of the head (14), so that the tufts of the outer rows (32, 34) and the arc-shaped toe (42) define an outer arc-shaped envelope (52).

2. The head (14) of claim 1, wherein at least some of the tufts of the outer rows (32, 34) and the arc-shaped toe (42) are inclined relative to the mounting surface (26) by an inclination angle (β) from about 65° to about 80°.

3. The head (14) of claim 2, wherein the at least some of the tufts of the outer rows (32, 34) and the arc-shaped toe (42) that are inclined relative to the mounting surface (26) are inclined in a direction towards the distal end (24).

4. The head (14) of claim 1, wherein the head (14) further comprises two inner rows of tufts (36, 38) extending from the mounting surface (26) and having a longitudinal extension and a cross-sectional area (54) extending substantially perpendicular to the longitudinal extension, the cross-sectional area (54) having an elongated shape with a longer axis (56) and a shorter axis (58), wherein the longer axis (56) is substantially parallel to the longitudinal axis (30) of the head (14).

5. The head (14) of claim 4, wherein the tufts of the inner rows (36, 38) are inclined with respect to the mounting surface (26) by an inclination angle (γ) from about 60° to about 85°.

6. The head (14) of claim 4, wherein the tufts of the inner rows (36, 38) are inclined in a direction towards the proximal end (22).

7. The head (14) of claim 4, wherein the outer rows of tufts (32, 34) and the arc-shaped toe (42) are composed of filaments having a substantially circular cross-sectional area, and the inner rows of tufts (36, 38) are composed of filaments having a cross-shaped cross-sectional area.

8. The head (14) of claim 4, wherein the tufts of the inner rows (36, 38) have a higher stiffness that the tufts of the outer rows (32, 34) do.

9. The head (14) of claim 1, wherein the head (14) further comprises a middle row of tufts (40) extending from the mounting surface (26).

10. The head (14) of claim 9, wherein the tufts of the middle row (40) have a longitudinal extension and a cross-sectional area having an elongated cross-sectional shape and extending substantially perpendicular to the longitudinal extension, the elongated cross-sectional shape having a longer axis and a shorter axis, wherein the longer axis is substantially parallel to the longitudinal axis of the head.

11. The head (14) of claim 9, wherein the middle row (40) is arranged between the inner rows (36, 38) along the longitudinal axis.

12. The head (14) of claim 11, wherein the tufts of the middle row (40) have a higher stiffness than the tufts of the inner rows (36, 38) do.

13. The head (14) of claim 1, wherein the tufts are attached to the head (14) by a hot-tufting process.

14. The head of claim 1, wherein the longer axis (48) defines an angle α of from about 30° to about 50° with respect to the longitudinal axis (30) of the head (14).

15. The head of claim 1, wherein the longer axis (48) defines an angle α of about 45° with respect to the longitudinal axis (30) of the head (14).

16. The head (14) of claim 1, wherein at least some of the tufts of the outer rows (32, 34) and the arc-shaped toe (42) are inclined relative to the mounting surface (26) by an inclination angle (β) from about 70° to about 80°.

17. The head (14) of claim 1, wherein at least some of the tufts of the outer rows (32, 34) and the arc-shaped toe (42) are inclined relative to the mounting surface (26) by an inclination angle (β) from about 74° to about 78°.

18. The head (14) of claim 5, wherein the inclination angle (γ) is from about 70° to about 80°.

19. The head (14) of claim 5, wherein the inclination angle (γ) is about 80°.

20. A kit (10) comprising a handle (12) and a head (14) of claim 1, wherein the head (14) is permanently attached or removably attachable to the handle (12).

21. The kit (10) of claim 20, wherein the head (14) is at least partially made from at least one of a non-magnetic material and a non-ferromagnetic material, and the handle (12) is at least partially made from at least one of a non-magnetic material and a non-ferromagnetic material.

* * * * *